US006925970B2

(12) United States Patent
Liu et al.

(10) Patent No.: US 6,925,970 B2
(45) Date of Patent: Aug. 9, 2005

(54) AIR-COOLED FOUR-STROKE INTERNAL COMBUSTION ENGINE

(75) Inventors: Yumin Liu, Fussa (JP); Yukio Sawadate, Akishima (JP); Masahiko Iizuka, Hamura (JP); Yoshiaki Nagao, Vernon Hills, IL (US)

(73) Assignee: Kioritz Corporation, Tokyo (JP)

( * ) Notice: Subject to any disclaimer, the term of this patent is extended or adjusted under 35 U.S.C. 154(b) by 0 days.

(21) Appl. No.: 10/828,294

(22) Filed: Apr. 21, 2004

(65) Prior Publication Data

US 2004/0206312 A1 Oct. 21, 2004

(30) Foreign Application Priority Data

Apr. 21, 2003 (JP) ..... 2003-115751

(51) Int. Cl.[7] ..... F02F 7/00; F02F 1/06

(52) U.S. Cl. ..... 123/41.69; 123/195 R; 123/41.7; 123/196 AB

(58) Field of Search ..... 123/41.69, 41.7, 123/195 C, 196 AB, 195 R

(56) References Cited

U.S. PATENT DOCUMENTS 1,365,438 A * 1/1921 Adamson ..... 184/104.3
2,321,097 A * 6/1943 Mills ..... 123/41.69
2,575,877 A * 11/1951 Klier ..... 123/196 AB
2,650,578 A * 9/1953 Daub ..... 123/41.69
4,154,182 A * 5/1979 Klundt ..... 112/280
4,610,228 A * 9/1986 Fink et al. ..... 123/195 C
4,835,405 A * 5/1989 Clancey et al. ..... 290/1 A
4,890,583 A * 1/1990 Ohno et al. ..... 123/41.7
6,394,060 B2 5/2002 Nagai et al.
6,640,443 B2 11/2003 Hüsges et al.

FOREIGN PATENT DOCUMENTS

JP 10077835 A * 3/1998 ..... F01P/5/06
JP 2001-207817 8/2001
JP 2002371846 A * 12/2002 ..... F01P/5/06

* cited by examiner

*Primary Examiner*—Noah P. Kamen
(74) *Attorney, Agent, or Firm*—Nixon Peabody LLP; Donald R. Studebaker

(57) ABSTRACT

The present invention provides an air-cooled four-stroke internal combustion engine capable of achieving a high degree of cooling. The present invention is directed to an air-cooled four-stroke internal combustion engine including a crankshaft and a fan rotor rotatably driven by the crankshaft to generate cooling air for cooling the engine. The engine comprises an oil pan disposed below the crankshaft. A space formed below the oil pan extends in the axial direction of the crankshaft along the lower surface of the oil pan and allows a cooling air to pass therethrough. An upstream portion of the lower surface is inclined upward, toward the upstream, in a vertical section taken along the axis of the crankshaft to receive the cooling air therein.

6 Claims, 6 Drawing Sheets

AIR-COOLED FOUR-STROKE INTERNAL COMBUSTION ENGINE

FIELD OF THE INVENTION

The present invention relates to an air-cooled four-stroke internal combustion engine. More particulary, the present invention relates to an air-cooled four-stroke engine comprising a fan rotor adapted to generate an airstream for cooling the engine.

BACKGROUND OF THE INVENTION

There has been known one type of four-stroke engine comprising a crank chamber, and an oil pan disposed below the crank chamber to contain lubrication oil therein, wherein engine components, such as a crankshaft and a connecting rod contained in the crank chamber are lubricated by oil mist generated in the oil pan, as disclosed, for example, in Japanese Patent Laid-Open Publication No. 2001-207817. This four-stroke engine is an air-cooled type in which an airstream generated by a fan rotor flows between cooling fins formed on the outer surface of a cylinder block.

Generally, if the oil pan has a temperature higher than an acceptable temperature, lubrication oil contained in the oil pan will be prematurely deteriorated or vaporized. Thus, it is important to prevent the oil pan from being heated at an excessively high temperature so as to maintain the lubrication oil at an adequate temperature. Further, a high temperature in an engine is likely to cause seizure in bearing. Therefore, it is also important to prevent the four-stroke engine from being excessively heated up so as to provide enhanced durability of components of the four-stroke engine. If the excessive heating is avoided, the materials of the four-stroke engine can also be selected with enhanced flexibility.

SUMMARY OF THE INVENTION

It is therefore art object of the present invention to provide an air-cooled four-stroke internal combustion engine capable of achieving a high cooling effect.

In order to achieve the above object, the present invention provides an air-cooled four-stroke engine including a crankshaft and a fan rotor adapted to be rotatably driven by the crankshaft to generate a cooling air for cooling the engine. This air-cooled four-stroke engine comprises an oil part disposed below the crankshaft, and a space formed below the oil pan to extend in the axial direction of the crankshaft along the lower surface of the oil pan and to allow a cooling air to pass therethrough. A portion of the lower surface upstream of the cooling air is inclined upward toward the upstream in the vertical section taken along the axis of the crankshaft to receive the cooling air therein.

In the present invention, airstream generated by the fan rotor passes through the space formed along the lower surface of the oil pan to forcedly cool the oil pan. This makes it possible to prevent deterioration and vaporization of the lubrication oil contained in the oil pan due to excessive heating so as to maintain adequate lubrication for a long period of time. The fan rotor may be designed to generate airstream for the space in either one of air-sending and air-sucking directions.

In a specific embodiment of the present invention, the oil pan has a bottom wall formed with a plurality of channels facing to the space. Each of the channels is defined by a corresponding convex bead extending along the axis of the crankshaft and protruding toward the inward side of the oil pan, to have an opening facing downward.

In this embodiment, the channel defined by the convex bead protruding toward the inward side of the oil pan provides a larger contact area with the lubrication oil contained in the oil pan. Thus, an airstream flowing through the channel provides an enhanced effect of cooling the lubrication oil to prevent premature deterioration or vaporization of the lubrication oil due to excessive heating. In addition, the convex bead provides enhanced rigidity in the oil pan. If a fuel tank is disposed below the oil pan, and the top surface of the fuel tank faces to the space, an effect of cooling the fuel tank can also be achieved by the airstream flowing through the channel.

In another embodiment of the present invention, the oil pan has a bottom wall formed with a plurality of fins each extending along the axis of the crankshaft and downward toward the space. An airstream flowing between the fins can cool the lubrication oil contained in the oil pan to prevent deterioration or vaporization of the lubrication oil due to excessive heating. In addition, the fins provide enhanced rigidity in the oil pan. If a fuel tank is disposed below the oil pan, and the top surface of the fuel tank faces the space, an effect of cooling the fuel tank can also be achieved by the airstream flowing through the space.

In order to achieve the above object, the present invention further provides an air-cooled four-stroke engine including a crankshaft and a fan rotor adapted to be rotatable driven by the crankshaft to generate an airstream for cooling the engine. This air-cooled four-stroke engine comprises an oil pan disposed below the crankshaft, and a pipe extending in the direction of the axis of the crankshaft to penetrate through the oil pan and lubrication oil contained in the oil pan so as to allow a cooling air to pass therethrough. In the present invention, the pipe passes through the inside of the lubrication contained in the oil pan Thus, cooling air passing through the pipe can achieve an enhanced effect of cooling the lubrication oil to prevent premature deterioration or vaporization of the lubrication oil.

In still another embodiment of the present invention, the air-cooled four-stroke engine includes a cylinder bock and a crankcase which are separated from one another in the lateral direction of the engine at a boundary between a cylinder defined by the cylinder bock and a crank chamber defined by the crankcase, and a heat shield member interposed between the cylinder bock and the crankcase to prevent the heat transfer from the cylinder block to the crankcase. In this embodiment, the heat shield member can prevent the heat transfer from the cylinder block to the crankcase to provide enhanced durability in the components contained in the crankcase. In addition, a material of the crankcase which has not been previously able to be used due to the high temperature of the crankcase, for example magnesium or synthetic resin, can be selected to reduce restrictions in design.

In yet another embodiment of the present invention, the air-cooled four-stroke engine includes a cylinder block integrally formed with at least the bottom wall of a valve chamber containing a camshaft in a rotatable manner, on the upward side of a cylinder defined by the cylinder block, and an air passage formed in the cylinder bock between the top wall of the cylinder and the bottom wall of the valve chamber to extend in the direction of the axis of the crankshaft. This structure can prevent the valve chamber from excessively heating to provide enhanced durability in components in the valve chamber. In addition, the components, such as cams, in the valve chamber can be made of a material which has not been previously able to be used due to the high temperature of the valve chamber, for example synthetic resin, to reduce restrictions in design. Further, the outer surface of the cylinder block may be formed with cooling fins protruding in the lateral direction of the engine as with the conventional engine. In this case, the airstream flowing between the cooling fine and the airstream passing through the space or the pipe can sufficiently cool the entire cylinder block.

DESCRIPTION OF THE PREFERRED EMBODIMENT

With reference to the drawings, various embodiments of an air-cooled four-stroke engine according to the present invention will now be described.

The air-cooled four-stroke engine according to the present invention is used as a power source for portable working machines or the like (e.g., a portable trimmer). The following description will be made in connection with one example where the air-cooled four-stroke engine is used in a portable trimmer.

Figure 1A:
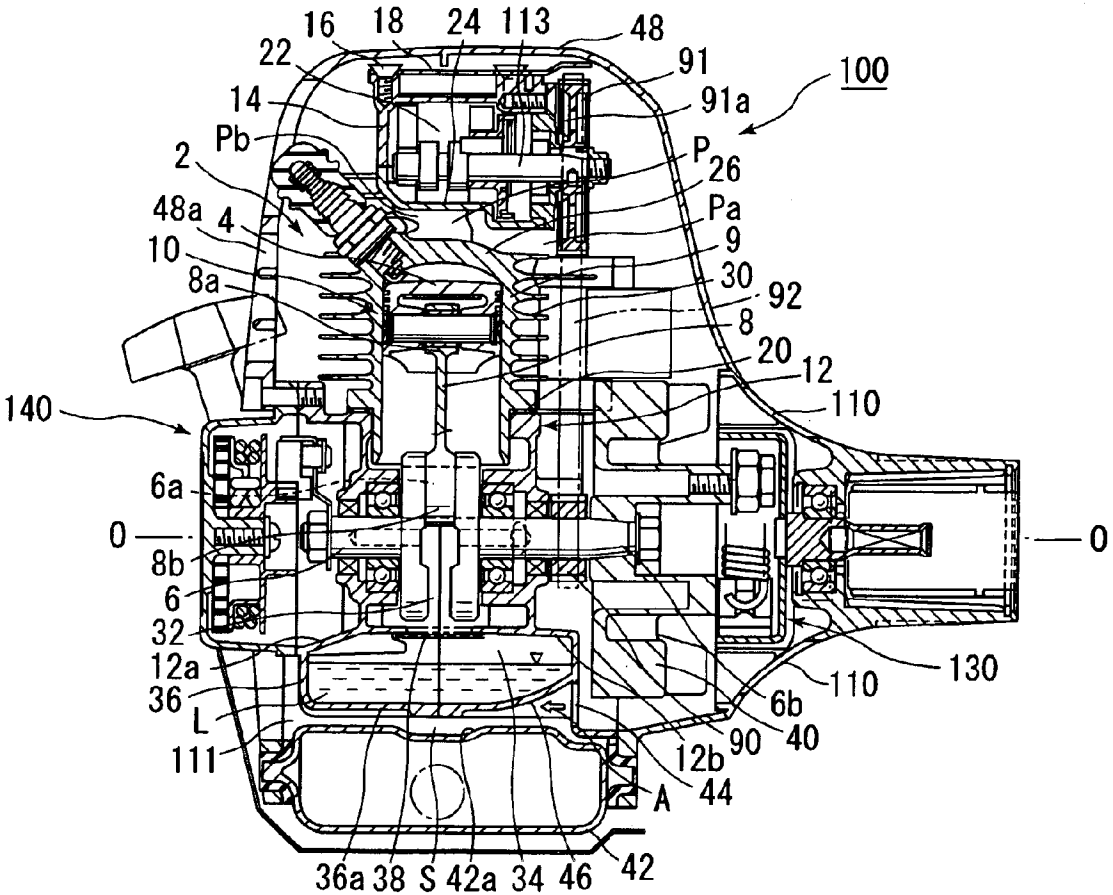
FIG. 1A is a vertical sectional view of a power output section provided on the rear end of a portable trimmer having an air-cooled four-stroke engine according to a first embodiment of the present invention, which is taken along the axis of a crankshaft of the air-cooled four-stroke engine.

FIG. 1A shows a power output section 100 provided on the rear end of a portable trimmer having an air-cooled four-stroke engine according to a first embodiment of the present invention. While the portable trimmer is omitted in FIG. 1A, it has a conventional structure comprising an output shaft which is contained in an operation rod linearly extending frontward from the power output section 100 and adapted to be driven by the drive section 100 through a centrifugal clutch 130, and a rotary blade adapted to be rotatably driven by the output shaft.

As shown in FIG. 1A, the air-cooled four-stroke engine 2 according to the first embodiment comprises a piston 4 adapted to be reciprocatingly moved in the vertical direction of the engine, a crankshaft 6 adapted to be rotatably driven in conjunction with the vertical reciprocating motion of the piston 4, and a connecting rod 8 which has an upper small end 8*a* connected to the piston 4 and a lower large end 8*b* connected to a crankpin 6*a* of the crankshaft 6.

The air-cooled four-stroke engine 2 has a cylinder block 10 and a crankcase 12 which are separated from one another in the crosswise direction of a piston chamber or cylinder 9 at the boundary between the cylinder 9 and a crank chamber 32. The air-cooled four-stroke engine 2 also has a cam case 14 connected to the top portion of the cylinder block 10 with bolts (not shown), and a cover 18 detachably fixed to the top portion of the cam case 14 with screws 16. The cam case 14 contains and rotatably supports a camshaft 113 having a driven sprocket wheel 91 fixed at the outer end thereof The driven sprocket wheel 91 is adapted to be rotatably driven by a driving sprocket wheel 90 fixed to the crankshaft 6, through a timing belt 92. The crankcase 12 is divided into rear and front halves 12*a*, 12*b* along a line extending vertically across the crankshaft 6. A heat shield member 20 is interposed between the respective opposed surfaces of the cylinder block 10 and the crankcase 12, to prevent the heat transfer from the cylinder block 10 to the crankcase 12. Preferably, the heat shield member 20 is a plate-shaped member formed of a carbon-containing rubber sheet excellent in heat insulation performance and sealing performance.

The cylinder block 10 includes an air passage P formed between the top wall 26 of the cylinder 9, and the bottom wall 24 of a valve chamber 22 defined by the cam case 14 and the cover 18 which are located above the cylinder 9. The bottom wall 24 of the valve chamber 22 is integrally formed with the cylinder block 10. The air passage P has an upstream opening Pa formed in the cylinder block 10 on the side of a fan rotor 40 which is fixed to the end 6*b* of the crankshaft 6 on the side of the centrifugal clutch 130 and also used as a magneto rotor. The air passage P also has a downstream opening Pb formed in the cylinder block 10 on the opposite side of the fan rotor 40. The air passage P extends from the upstream opening Pa to downstream opening Pb in the axial direction of the crankshaft 6. The outer surface of the cylinder block 10 is formed with a plurality of cooling fins 30 protruding in the lateral direction of the engine.

The inner space of the crankcase 12 is formed as the crank chamber 32 for containing the crankshaft 6. On the underside of the crankcase 12, an oil pan 36 is integrally formed with the bottom wall of the crankcase 12. The oil pan 36 defines an oil reservoir chamber 34 for receiving lubrication oil therein. The crank chamber 32 and the oil reservoir chamber 34 are in fluid communication with one another through an opening 38 formed in the bottom wall of the crankcase 6 and provided with a meshed member, so as to allow oil mist created in the oil reservoir chamber 34 to be supplied to the crank chamber 32 through the opening 38.

As described above, the fan rotor 40 is attached to the end 6*b* of the crankshaft 6. More specifically, the fan rotor 40 is located adjacent to the front side of the crankcase 12. The fan rotor 40 has a radius allowing the peripheral edge thereof to be located adjacent to an upstream portion 46 of a cooling-air space provided below the bottom wall of the oil pan 36, discussed in more detail below.

A fuel tank 42 is disposed below the oil pan 36. The lower surface 36*a* of the oil pan 36 and the top surface 42*a* of the fuel tank 42 are spaced apart from one another to form therebetween a space S which extends along the lower surface 36*a* of the oil pan 36 in the direction of the axis O-O of the crankshaft 6 to allow a part A of cooling air generated by the fan rotor 40 to flow therethrough. While the fan rotor 40 in the first embodiment is designed to generate airstream in a direction allowing the cooling air to be sent into the space S (hereinafter referred to as "air-sending direction"), the fan rotor 40 may also be designed to generate airstream in a direction allowing the cooling air to be sucked from the space S (hereinafter referred to as "air-sucking direction"). Thus, upstream of the cooling airflow in the first embodiment is the fan rotor 40. The crankcase 12 has an opening 44, formed at a position adjacent to the peripheral edge of the fan rotor 40, to provide the upstream end of the space S. In the first embodiment, a plural number of the openings 44 are formed in the crankcase 12 to represent the upstream end of the space S between the oil pan 36 and the fuel tank 42, and these openings 44 are the arranged along a line extending in the lateral direction of the engine and in the perpendicular direction of the axis of the crankshaft 6.

As seen in FIG. 1A, a portion 46 of the lower surface 36*a* of the bottom wall of the oil pan 36, located at the upstream portion of the airstream A, is inclined upward toward the upstream in the vertical section taken along the axis O-O of the crankshaft 6, to receive the airstream A therein. In other words, the upstream portion 46 of the lower surface 36*a* of the oil pan 36 is inclined upward, toward the upstream, to provide a large air-inlet opening of the space S facing toward the upstream. This structure makes it possible to introduce a larger volume of air into the space S smoothly.

Figure 1B:
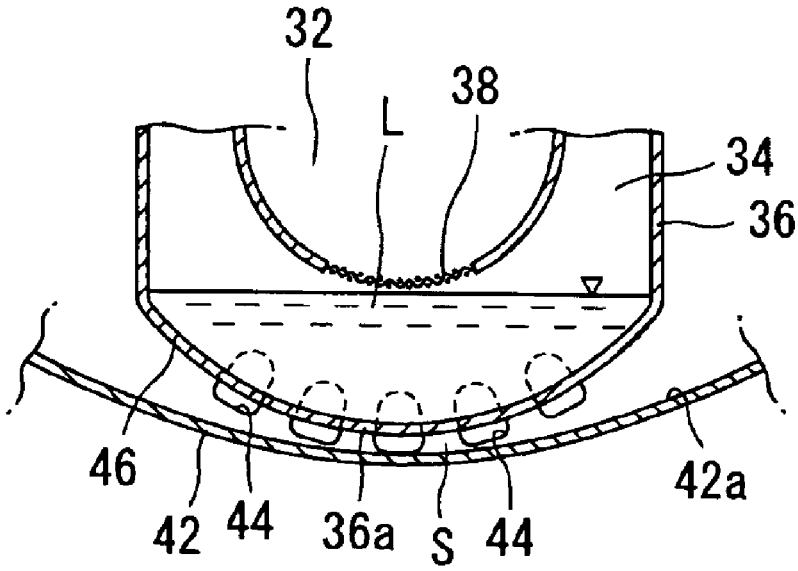
FIG. 1B is a fragmentary vertical sectional view of an oil pan and a fuel tank, which is taken along a line perpendicular to the axis of the crankshaft.

As shown in FIG. 1B, the upstream portion 46 of the lower surface 36*a* of the bottom wall of the oil pan 36 is formed as a smooth surface, substantially without irregularity in the vertical section taken along a line perpendicular to the axis O-O of the crankshaft 6. All of the air-cooled four-stroke engine 2, the fuel tank 42 and the fan rotor 40 are contained in a housing 48.

When the air-cooled four-stroke engine 2 according to the first embodiment is turned over (started) by operating a recoil starter 140, the crankshaft 6 rotates, and the fan rotor 40 is rotationally driven by the crankshaft 8 to send cooling air toward the air-cooled four-stroke engine 2. A part A of the cooling air is introduced from the openings 44 into the space S formed below the oil pan 36. The airstream A flows through the space S to forcibly cool lubrication oil L in the oil pan 36 located above the space S and fuel in the fuel tank 42 located below the space S, and runs out from the outlet 111 located below the recoil starter 140.

A part of the airstream generated by the fan rotor 40 flows upward within the housing 48, and passes through the air passage P. The airstream flowing through the air passage P acts to forcedly cool the valve chamber 22 located above the air passage P to prevent the valve chamber 22 from being excessively heated up by heat from the cylinder block 10. Further, a part of the cooling air flows between the cooling fins 30 of the cylinder block 10 to cool the cylinder block 10. Then, the cooling air is discharged outside from slits 48*a* formed in the housing 48. A fan section 91*a* may be formed in the driven sprocket wheel 91 to obtain an enhanced effect of cooling the valve chamber 22.

Figure 2A:
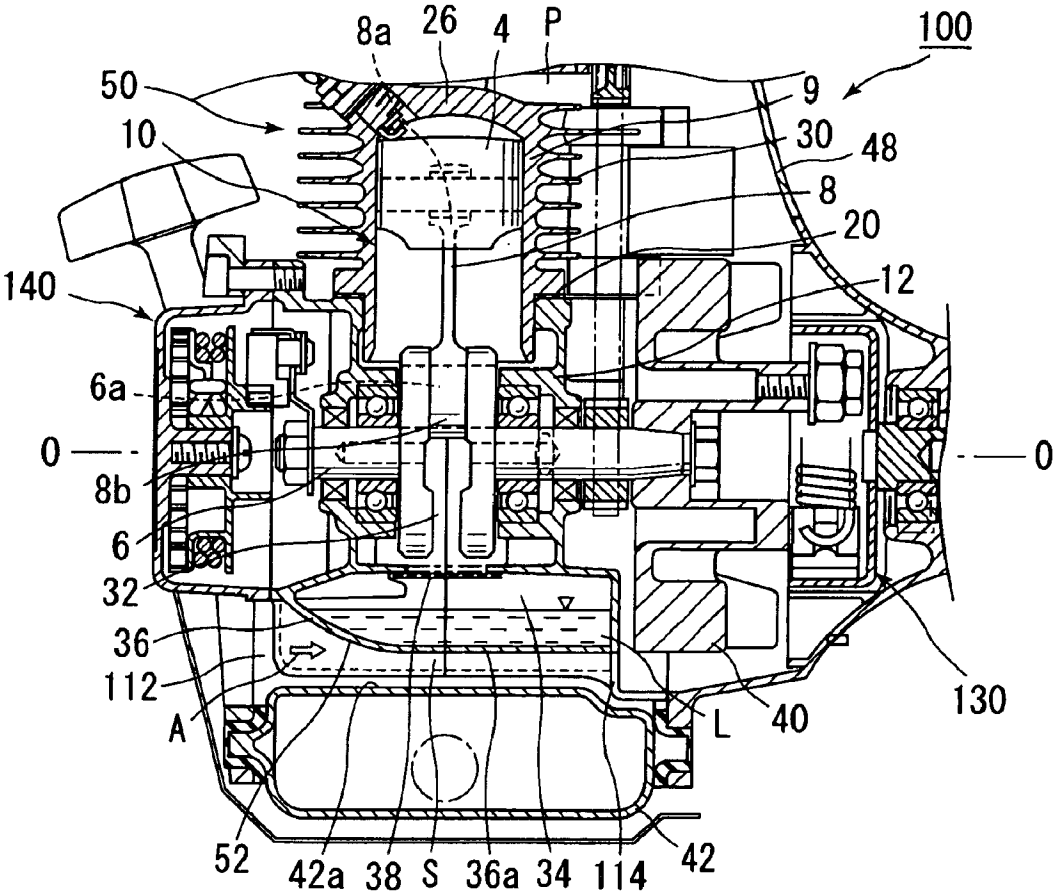
FIG. 2A is a vertical sectional view of a power output section of a portable trimmer having an air-cooled four-stroke engine according to a second embodiment of the present invention, which is taken along the axis of a crankshaft of the air-cooled four-stroke engine.
Figure 2B:
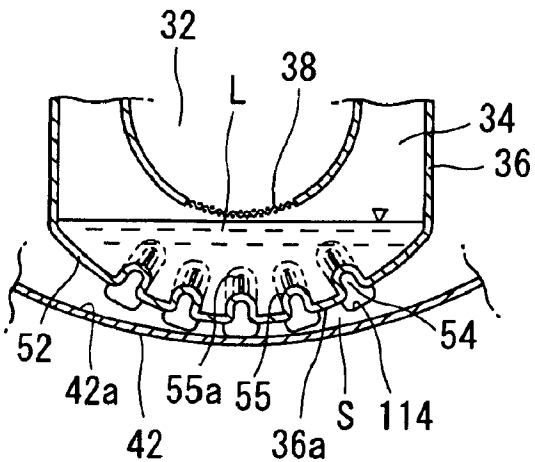
FIG. 2B is a fragmentary vertical sectional view of an oil pan and a fuel tank, which is taken along a line perpendicular to the axis of the crankshaft.

The air-cooled four stroke engine 50 of a second embodiment of the present invention has the same structure as that of the air-cooled four-stroke engine 2 according to the first embodiment except for the shape of the lower surface 36*a* of the bottom wall 52 of an oil pan 36 and the flow direction of a cooling air A generated by a fan rotor 40. In FIGS. 2A and 2B, the same component or element as that in the first embodiment is defined by the same reference numeral or code, and its detailed description will be omitted. The following description will be made while focusing on different points-from the first embodiment.

The rotation direction of the fan rotor 40 in the second embodiment is reversed as compared to the first embodiment. That is, the airstream generated by the fan rotor 40 flows in the air-sucking direction, and downstream of the cooling airflow, in the second embodiment, is the fan rotor 40. Thus, as seen in FIG. 2A, a portion 52 of the lower surface 36*a* of the oil pan 36 located at the upstream portion of the cooling air A is inclined upward toward the upstream in the vertical section taken along the axis O-O of a crankshaft 6, to receive the airstream A therein. In other words, the upstream portion 52 of the lower surface 36*a* of the oil pan 36 is inclined upward toward the upstream to provide a large air-inlet opening 112 of a space S facing toward the upstream. This structure makes it possible to introduce a larger volume of air into the space S, and sucked toward a fan suction hole 114 formed in a crankcase 12 at a position adjacent to the peripheral edge of the fan rotor 40.

In addition, as shown in FIG. 2B, the lower surface 36*a* of the oil pan 36 is formed with a plurality of channels 54 facing the space S. Each of the channels 54 is defined by a corresponding convex bead protruding toward the inward side of the oil pan 36 and extending along the axis O-O of the crankshaft 6, to have an opening facing downward. More specifically, each of the convex beads 55 defining the channels 54 has a reverse-U shape in the vertical section taken along a line perpendicular to the axis O-O of the crankshaft 6. The plurality of convex beads 55 are arranged at given intervals to form a corrugated shape as a whole. Additionally, each of the convex beads 55 can be formed with a fin 55*a* protruding from the top thereof to adequately control the movement of lubrication oil L and provide enhanced heat-absorbing effect.

When the air-cooled four-stroke engine 50 according to the second embodiment is turned over (started) by operating a recoil starter 140, the crankshaft 6 rotates, and the fan rotor 40 is rotationally driven by the crankshaft 6 to suck the cooling air A from the upstream opening 112 toward the fan rotor 40. The cooling air A flows through the space S formed below the oil pan 36 to forcibly cool the lubrication oil L in the oil pan 36 located above the space S and fuel in a fuel tank 42 located below the space S. The cooling air A also flows through the channels 54 to provide an enhanced effect of cooling the lubrication oil in the oil pan 36.

Figure 3A:
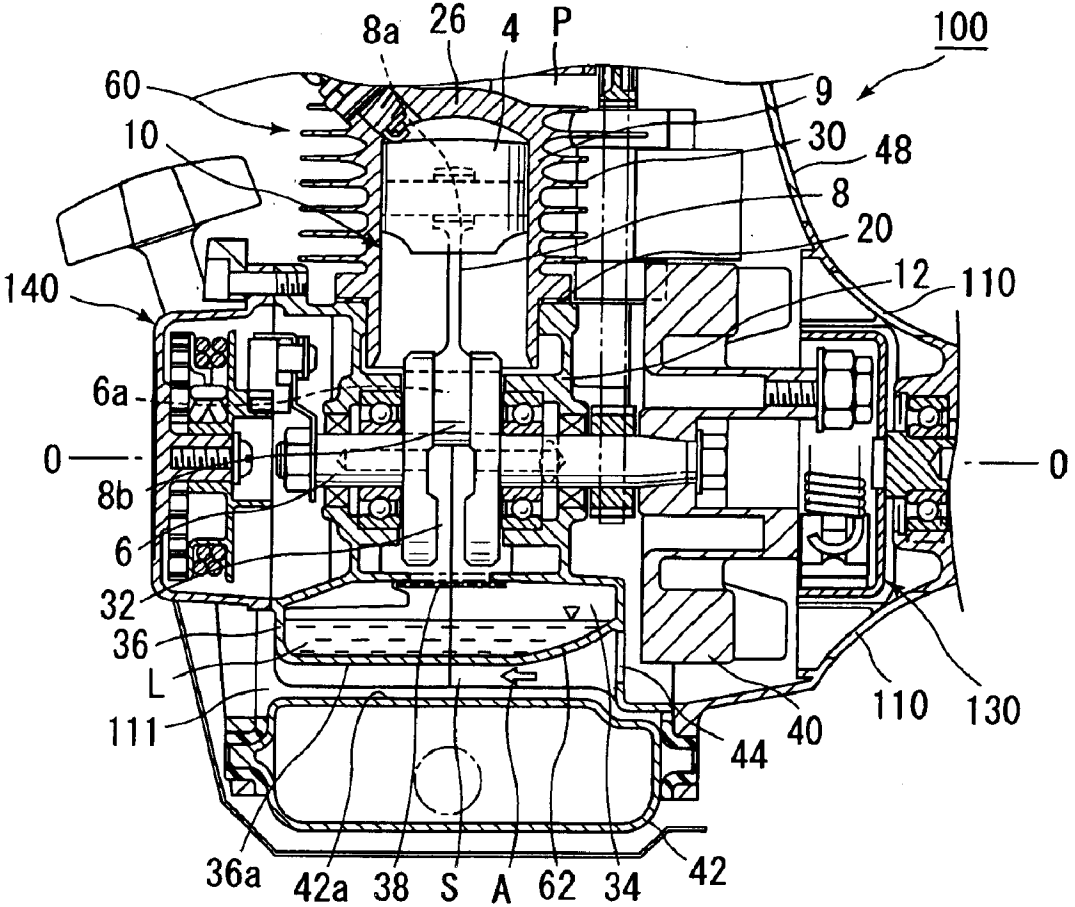
FIG. 3A is a vertical sectional view of a power output section of a portable trimmer having an air-cooled four-stroke engine according to a third embodiment of the present invention, which is taken along the axis of a crankshaft of the air-cooled four-stroke engine.
Figure 3B:
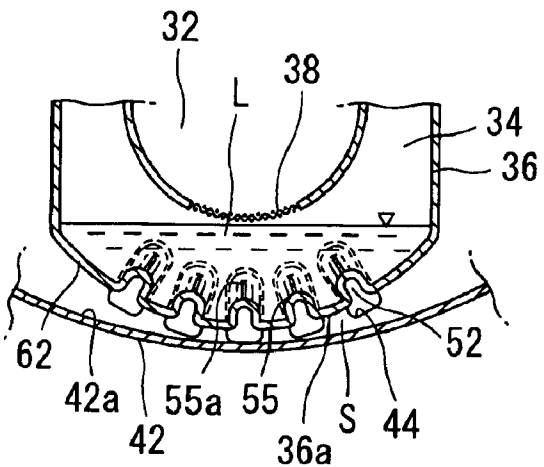
FIG. 3B is a fragmentary vertical sectional view of an oil pan 36 and a fuel tank, which is taken along a line perpendicular to the axis of the crankshaft.

The air-cooled four-stroke engine 60 according to a third embodiment of the present invention has the same structure as that of the air-cooled four-stroke engine 50 according to the second embodiment except for the shape of the lower surface 36*a* of an oil pan 36 and the flow direction of a cooling air A generated by a fan rotor 40. In FIGS. 3A and 3B, the same component or element as that in the second embodiment is defined by the same reference numeral or code, and its detailed description will be omitted. The following description will be made while focusing on different paints from the second embodiment.

The rotation direction of the fan rotor 40 in the third embodiment is reversed as compared to the second embodiment. That is, the cooling air A generated by the fan rotor 40 flows in the air-sending direction, and upstream of the cooling airflow in the third embodiment is the fan rotor 40.

Thus, as seen in FIG. 3A, a portion 62 of the lower surface 36*a* of the bottom wall 62 of the oil pan 36, located at the upstream portion of the airstream, is inclined upward toward the upstream in the vertical section taken along the axis O-O of a crankshaft 6, to receive the airstream A therein. In other words, the portion 62 of the lower surface 36*a* of the oil pan 36 is inclined upward toward the upstream to provide a large air-inlet opening of a space S facing toward the upstream. This structure makes it possible to introduce the cooling air A into the space S at a larger volume.

Figure 4A:
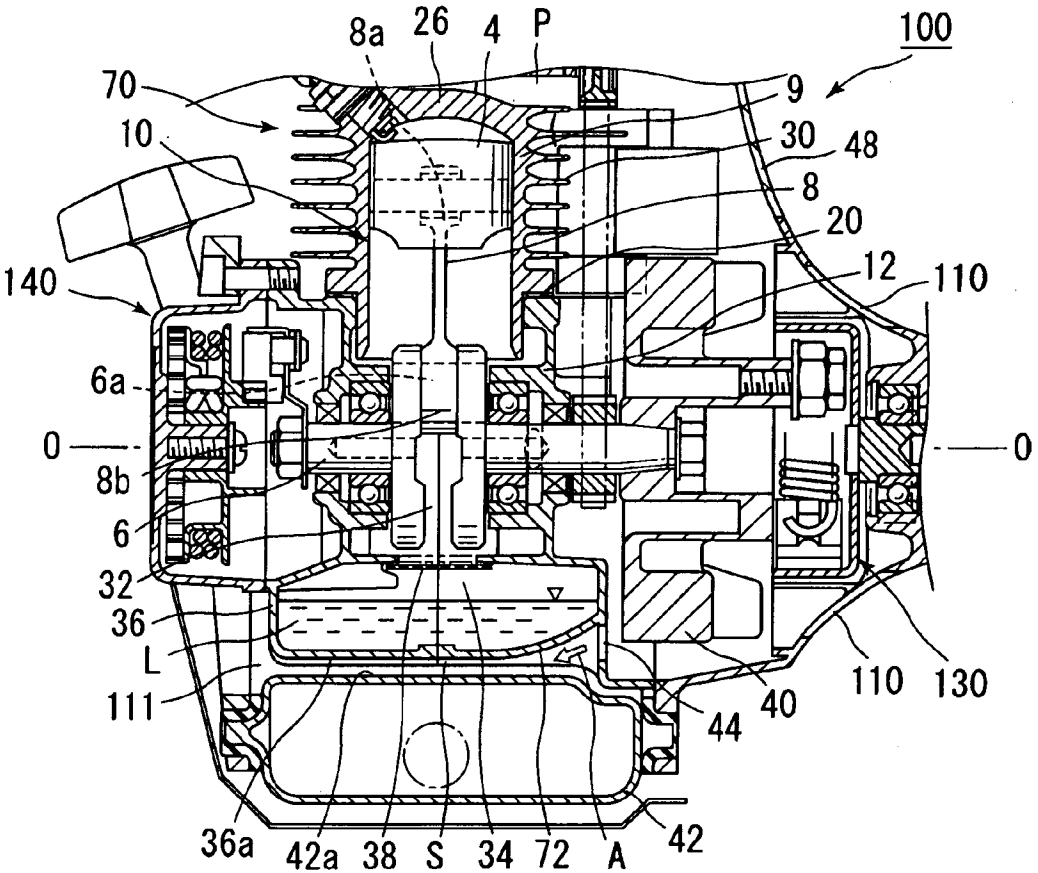
FIG. 4A is a vertical sectional view of a power output section of a portable trimmer having an air-cooled four-stroke engine according to a fourth embodiment of the present invention, which is taken along the axis of a crankshaft of the air-cooled four-stroke engine.
Figure 4B:
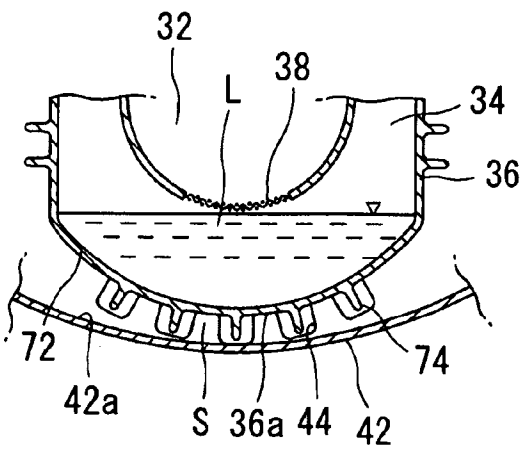
FIG. 4B is a fragmentary vertical sectional view of an oil pan and a fuel tank, which is taken along a line perpendicular to the axis of the crankshaft.

The air-cooled four-stroke engine 70 according to a fourth embodiment has the same structure as that of the air-cooled four-stroke engine 2 according to the first embodiment except for the shape of the lower surface 36*a* of an oil pan 36. In FIGS. 4A and 4B, the same component or element as that in the first embodiment is defined by the same reference numeral or code, and its detailed description will be omitted. The following description will be made while focusing on different points from the first embodiment.

As shown in FIG. 4B, an upstream portion 72 of the lower surface 36*a* of the bottom wall of the oil pan 36 is formed with a plurality of fins 74 extending downward toward a space S and in the direction of the axis O-O of a crankshaft 6. More specifically, the plurality of fins 74 protrude downward from the upstream portion 72 of the lower surface while being arranged at given intervals, in the vertical section taken along a line perpendicular to the axis of the crankshaft 6.

When the air-cooled four-stroke engine 70 according to the fourth embodiment is turned over (started) by operating a recoil starter 140, the crankshaft 6 is rotates, and a fan rotor 40 is rotationally driven by the crankshaft 6 to send cooling air from the fan rotor 40 toward the air-coaled four-stroke engine 70. A part A of the cooling air flows through a space S formed below the oil pan 36 to forcibly cool the lubrication oil L in the oil pan 36 located above the space S and fuel in a fuel tank 42 located below the space S. The cooling air A also flows between the fins to provide an enhanced effect of cooling the lubrication oil L in the oil pan 36.

As compared to the first embodiment having the space S formed below the oil pan 36 to allow the cooling air A to pass therethrough, the air-cooled four-stroke engine 80 according to a fifth embodiment includes a pipe 84 extending in the direction of the axis O-O of the crankshaft 6 to penetrate through lubrication oil L contained in a oil pan 36, instead of the space 5, and the bottom wall 82 of the oil pan 36 has a different shape. Except for these points, the air-cooled four-stroke engine 80 according to the fifth embodiment has the same structure as that of the air-cooled four-stroke engine 2 according to the first embodiment. In FIGS, 5A and 5B, the same component or element as that in the first embodiment is defined by the same reference numeral or code, and its detailed description will be omitted. The following description will be made while focusing on different points from the first embodiment.

Figure 5A:
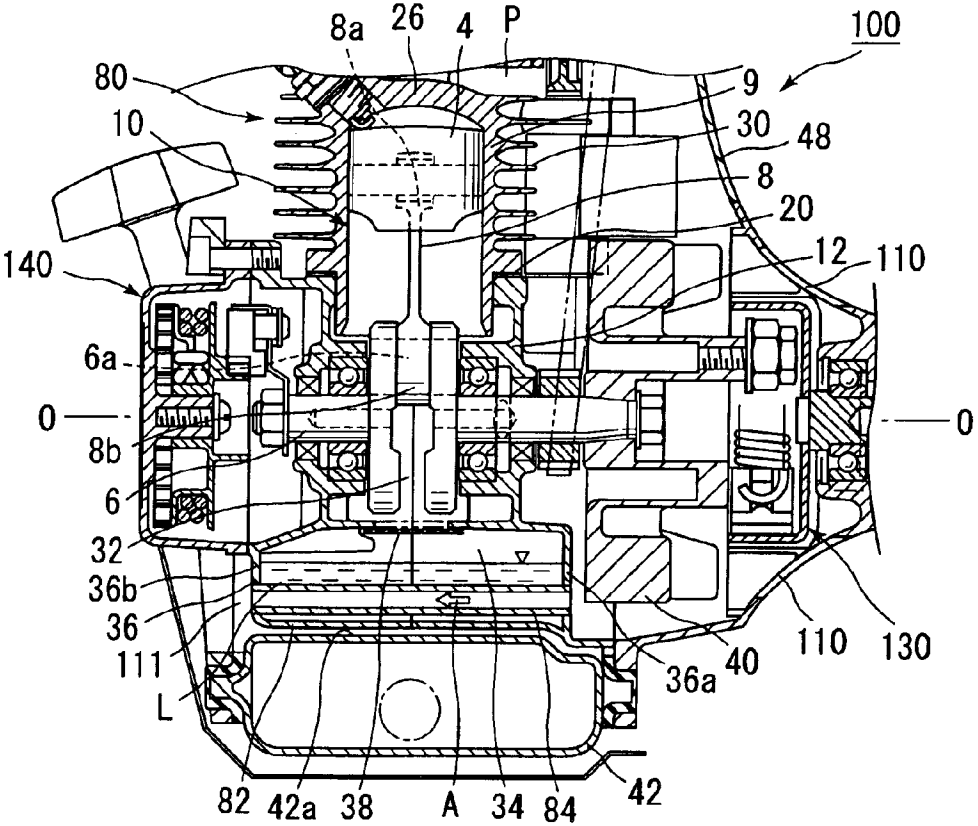
FIG. 5A is a vertical sectional view of a power output section of a portable trimmer having an air-cooled four-stroke engine according to a fifth embodiment of the present invention, which is taken along the axis of a crankshaft of the air-cooled four-stroke engine.

As shown in FIG. 5A, in the air-cooled four-stroke engine 80 according to fifth embodiment, the bottom wall 82 of the oil pan 36 extends straight in parallel with the axis O-O of the crankshaft 6 in the vertical section taken along the axis O-O of the crankshaft 6.

Further, the air-cooled four-stroke engine 80 according to fifth embodiment includes the pipe 84 which extends in the direction of the axis O-O of the crankshaft 6 to penetrate through the oil pan 36 and the lubrication oil L contained therein and allows cooling air A to pass therethrough. As shown in FIG. 5A, the pipe 84 extends straight in parallel with the axis O-O of the crankshaft 6 in the vertical section taken along the axis O-O of the crankshaft 6. The oil pan has a vertically extending front wall 36*a* on the side of the fan rotor 40, and a vertically extending rear wall 36*b* on the opposite side of the fan rotor 40. The front and rear open ends of the pipe 82 are liquid-tightly connected, respectively, to the front wall 36*a* and rear wall 36*b* while allowing the front and rear open ends of the pipe 82 to be in fluid communication with the outside. The pipe 82 has a cross-sectionally circular shape.

Figure 5B:
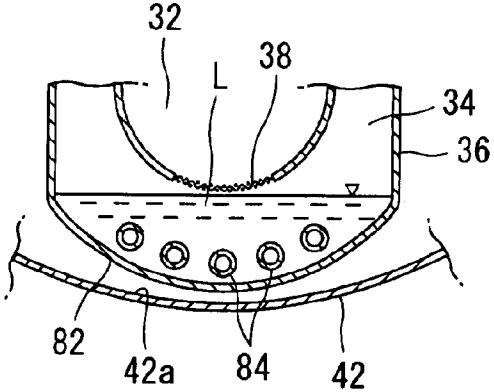
FIG. 5B is a fragmentary vertical sectional view of an oil pan and a fuel tank, which is taken along a line perpendicular to the axis of the crankshaft.

As shown in FIG. 5B, in the vertical section taken along a line perpendicular to the axis of the crankshaft 6, a plural number of the pipes 82 are arranged in the lateral direction of the oil pan 36 at given intervals while being spaced apart upward from the bottom wall 82 of the oil pan 36, to extend in the lubrication oil L contained in the oil pan 36. This arrangement makes it possible to adequately cool the lubrication oil L contained in the oil pan 36.

When the air-cooled four-stroke engine 80 according to the fifth embodiment is turned over (started) by operating a recoil starter 140, the crankshaft 6 rotates, and the fan rotor 40 is rotationally driven by the crankshaft 6 to send cooling air from the fan rotor 40 toward the air-cooled four-stroke engine 80. A part A of the cooling air flows through the pipes 82 to cool the lubrication oil L contained in the oil pan 36.

While the air-cooled four-stroke engine 80 according the fifth embodiment has substantially no space between the oil pan 36 and the fuel tank 42, a sufficient space S for allowing airstream to pass therethrough as in the first embodiment may be formed between the oil pan 36 and the fuel tank 42 to provide an enhanced cooling effect.

The present invention is not limited to the above embodiments, but various modifications can be made without departing from the spirit and scope of the present invention as set forth in appended claims. It is understood that such modifications are also encompassed within the scope of the present invention.

For example, the shape of the convex bead 55 defining the channel 54 in the second embodiment is not limited to the reverse-U shape, but any other suitable shape protruding toward the inward side of the oil pan 36, such as a reverse-V shape, may be used.

Further, the crass-sectional shape of the pipe 82 in the fifth embodiment is not limited to a circular shape, but any other suitable shape may be used.

What is claimed is:

1. An air-cooled four-stroke internal combustion engine comprising:

a crankshaft;

a fan rotor adapted to be rotatably driven by said crankshaft to generate a cooling air for cooling said engine;

an oil pan disposed below said crankshaft;

a fuel tank disposed below said oil pan; and a space being formed between said oil pan and said fuel tank and extending in the axial direction of said crankshaft along the lower surface of said oil pan and allow a cooling air to pass therethrough, wherein an upstream portion of said lower surface, is inclined upward, toward the upstream, in a vertical section taken along the axis of said crankshaft to receive said cooling air therein.

2. The air-cooled four-stroke internal combustion engine as defined in claim 1, wherein said oil pan has a bottom wall formed with a plurality of channels facing said space, each of said channels being defined by a corresponding convex bead extending along the axis of said crankshaft and protruding toward the inward side of said oil pan, to have an opening facing downward.

3. The air-cooled four-stroke internal combustion engine as defined in claim 1, wherein said oil pan has a bottom wall formed with a plurality of fins each extending along the axis of said crankshaft and downward toward said space.

4. An air-cooled four-stroke internal combustion engine comprising:

a crankshaft a fan rotor adapted to be rotatable driven by said crankshaft to generate an airstream for cooling said engine;

an oil pan disposed below said crankshaft;

a fuel tank disposed below said oil pan;

a pipe extending in the direction of the axis of the crankshaft to penetrate through said oil pan and lubrication oil contained in said oil pan so as to allow a cooling air to pass therethrough; and a space being formed between said oil pan and said fuel tank and extending in the axial direction of said crankshaft along the lower surface of said oil pan and allow cooling air to pass therethrough.

5. The air-cooled four-stroke internal combustion engine as defined in claim 1 or 4, further comprising:

a cylinder block and a crankcase which are separated from one another in a lateral direction of said engine at the boundary between a cylinder defined by said cylinder block and a crank chamber defined by said crankcase, and a heat shield member interposed between said cylinder block and said crankcase to prevent heat transfer from said cylinder block to said crankcase.

6. The air-cooled four-stroke internal combustion engine as defined in claim 1 or 4, further comprising:

a valve chamber;

a camshaft located in a camcase in a rotatable manner;

a cylinder block integrally formed with at least the bottom wall of said valve chamber on the upward side of a cylinder defined by said cylinder block; and an air passage formed in said cylinder block between the top wall of said cylinder and said bottom wall of said valve chamber to extend in the direction of the axis of said crank shaft.

* * * * *